United States Patent [19]

Yardley et al.

[11] Patent Number: 4,570,112

[45] Date of Patent: Feb. 11, 1986

[54] CONTROL CIRCUIT FOR NUMERICALLY CONTROLLED MOTOR

[75] Inventors: Robert Yardley, Leicester; Ewen R. Cameron, Leicestershire; Joseph A. Shutt, Leicestershire; Andrew G. N. Walter, Leicestershire, all of England

[73] Assignee: USM Corporation, Farmington, Conn.

[21] Appl. No.: 554,555

[22] Filed: Nov. 23, 1983

[30] Foreign Application Priority Data

Nov. 24, 1982 [GB] United Kingdom ..... 8233506

[51] Int. Cl.[4] ..... G05B 19/28

[52] U.S. Cl. ..... 318/602; 318/604; 318/663; 318/39

[58] Field of Search ..... 318/663, 602, 601, 39, 318/571, 604; 364/479

[56] References Cited

U.S. PATENT DOCUMENTS

| | | | |
|---|---|---|---|
| 3,723,842 | 3/1973 | Sather | 318/602 |
| 3,752,969 | 8/1973 | Kiffmeyer et al. | 318/602 X |
| 3,826,964 | 7/1974 | Byrne | 318/602 |
| 4,081,732 | 3/1978 | Aoyama | 318/601 X |
| 4,464,614 | 8/1984 | Kurakake | 318/663 X |
| 4,473,786 | 9/1984 | Miyashita | 318/602 X |

*Primary Examiner*—B. Dobeck

*Attorney, Agent, or Firm*—William F. White

[57] ABSTRACT

A numerically controlled motor provides a drive at a rate which is proportional to rotation of an independently driven shaft. In addition, the ratio of such rate to such rotation can be varied by a control circuit by which, in response to each pulse supplied by an encoder on said shaft, an incremental value, corresponding to an analogue signal supplied by a potentiometer to an A-D converter, which converts said signal to said value, is supplied to an accumulator, which sums the successively supplied increment values and, at a predetermined cumulative value, "overflows", such "overflow" supplying a drive signal to the n.c. motor. The potentiometer is manually set by an operator to vary the increment value and thus the frequency of "overflow" in relation to shaft rotation. The control circuit also enables "reverse" and "fast forward" drive to the motor independently of the shaft.

18 Claims, 2 Drawing Figures

MI
E
S5
R
C
RAM
CPU
DB
EPROM
D
I/P
ADC
I/O B
O/P
TS1
TS2
TS3
VR4
VR5
VR6
S4
S6
S7
S8
H1
H2
H3
M
SMD
SOL1
SOL2
RL1

CONTROL CIRCUIT FOR NUMERICALLY CONTROLLED MOTOR

FIELD OF THE INVENTION

This invention is concerned with a computer controlled circuit for a numerically controlled motor. In particular, this invention is concerned with utilizing the aforementioned motor control apparatus which supplies a liquid composition.

BACKGROUND OF THE INVENTION

This invention is concerned with a computer-controlled control circuit for an n.c. motor. The term "n.c.motor" where used herein is to be understood as indicating a motor the operation of which is controlled by control pulses supplied thereto in accordance with digitised information appropriate to the desired operation of the motor. Examples of such motors are stepping motors and d.c. servo motors.

OBJECTS OF THE INVENTION

It is one of the objects of the present invention to provide a simplified form of control circuit by which the rate of operation of a numerically controlled motor can be controlled.

It is a further object of the present invention to provide a simplified gearing arrangement suitable for use with an n.c. motor.

SUMMARY OF THE INVENTION

The invention provides, in one of its aspects, a computer-controlled control circuit for an n.c. motor (as hereinbefore defined) comprising a potentiometer by which an analogue signal can be supplied, an anologue-to-digital converter which receives the analogue signal from the potentiometer and by which, in response to an address at timed intervals, a corresponding digital "increment" value is supplied to an accumulator, which sums the successively supplied increment values, said accumulator "overflowing" each time it reaches a predetermined value, wherein each time the accumulator "overflows", a signal is supplied to the computer in response to which a drive signal is supplied thereby to the n.c. motor.

The invention is more particularly concerned with the control of an n.c. motor whereby such motor is caused to be driven at a rate proportional to the rotation of an independently driven shaft. To this end, the invention further provides, in another of its aspects, a computer-controlled control circuit for an n.c. motor (as hereinbefore defined) whereby such motor is caused to be driven at a rate proportional to the rotation of an independently driven shaft, the control circuit comprising an encoder driven by said shaft and operable, in response to rotation of said shaft, to supply a series of pulses to the computer, a potentiometer by which an analogue signal can be supplied, an analogue-to-digital converter which receives the analogue signal from the potentiometer and by means of which, in response to an address by the computer each time the latter receives a pulse from the encoder, a corresponding digital "increment" value is supplied by an accumulator which sums the successively applied increment values, said accumulator "overflowing" each time it reaches a predetermined value, wherein each time the accumulator "overflows", a signal is supplied to the computer, in response to which signal a drive signal is supplied to the n.c. motor to cause it to be driven through a predetermined distance.

It will be appreciated that, by this relatively simple arrangement, the need for a conventional gear-box is eliminated, and thus both space and cost can be saved.

Furthermore, by using an electronic "gear-box" arrangement, further facilities can readily be provided, which would be provided only with difficulty in the case of a conventional gear-box arrangement. Thus, in the control circuit in accordance with the invention means may be provided, operable in response to a signal, to cause the n.c. motor to be driven in a reverse direction through a predetermined distance, independently of the rotation of the shaft. Conveniently, said reverse drive means comprises operator-controlled means, including a second potentiometer, whereby the distance through which the n.c. motor is so driven can be set by the operator. In one circuit in accordance with the invention, the signal causing operation of the reverse drive means to take place is supplied upon actuation of switch means disconnecting the n.c. motor from said shaft.

A further facility which may be provided in the control circuit in accordance with the invention, furthermore, resides in that, after the n.c. motor has been so driven in a reverse direction, said motor is driven, upon being appropriately signalled, through a predetermined distance in a forward direction, independently of the rotation of said shaft. Where, furthermore, the signal causing operation of the reverse drive means is supplied upon actuation of the switch means, the operation of the n.c. motor in the forward direction as aforesaid may then take place upon re-actuation of said switch means.

Preferably, the predetermined distsance through which the n.c. motor is independently driven as aforesaid is the same, or substantially the same, as the predetermined distance through which said motor was previously driven in a reverse direction.

The encoder of the control circuit conveniently comprises a disc having a plurality of equally spaced notches which, as the shaft rotates, are moved past a sensor device by which appropriate signals can be passed to the computer. In order to prevent the encoder from supplying spurious signals when the shaft is at rest, e.g. if the shaft comes to rest with an edge of a notch aligned with the sensor device, and the disc or device is caused to vibrate by the usual machine vibrations, in accordance with the invention the sensor device preferably comprises two sensors arranged to supply signals in sequence to a set/re-set device, the arrangement being such that, when the edge of a notch is aligned with a first one of said sensors, the other sensor is located so as to be positioned opposite a portion of the disc between two adjacent notches. In this way, the sensor device will provide a first signal from the first sensor, but no signal will be forthcoming from the second sensor until rotation of the shaft is re-commenced.

The above features of the control circuit have been found to be especially advantageous in apparatus for supplying a liquid composition through a nozzle at a desired rate. To this end, the invention further provides, in yet another of its aspects, apparatus for supplying a liquid composition through a nozzle at a feed rate which is proportional to the rate at which a workpiece is fed past said nozzle, the apparatus comprising a gear pump connected to a supply of liquid composition, an n.c. motor (as hereinbefore defined) for driving said gear pump, and a computer-controlled control circuit as set out in the last five preceding paragraphs above, wherein the rate at which a workpiece is fed past the nozzle is controlled by the rotation of said shaft.

In such a machine, the use of the reverse drive means can be effected to cause the liquid composition to be sucked back at the end of an operating cycle, thereby enabling problems of drooling of cement to be overcome or mitigated. Similarly, the subsequent drive in a forward direction can be utilized to ensure that there is no starvation of the liquid composition when the next working cycle is initiated.

In addition, conveniently in such an apparatus, operator-actuatable means is provided for varying the setting of the first-mentioned potentiometer, thus to vary the amount of liquid composition supplied in relation to the feed rate of the workpiece. It has been found to be desirable that the ratio of the rate of rotation of the shaft to the rate at which the n.c. motor is driven can be varied in the range 40:1 to 400:1.

A further advantage which the use of an electronic "gear-box" arrangement can provide is also to be found where the apparatus comprises workpiece feeding means, including a motor, by which said shaft is driven, and a workpiece-engaging arrangement operable, in response to rotation of said shaft, to engage and feed the workpiece, together with means by which the rate at which a workpiece is fed by the workpiece feeding means past the nozzle can be varied without altering the speed of rotation of said shaft. This feature is to be found especially where the workpiece-engaging arrangement is in the form of an orbitally driven hammer-and-anvil arrangement. In such a case, in accordance with the invention means may be provided, operable in response to a change in the workpiece feed rate, to vary the increment value supplied to the accumulator, thus to cause the rate at which liquid composition is supplied through the nozzle to be varied accordingly. In case it is desired to alter the workpiece feed rate without altering the rate at which the liquid composition is supplied, however, conveniently switch means may be provided for enabling/disabling the means for varying the increment value as aforesaid.

It will thus be appreciated that, using a control circuit in accordance with the invention, a relatively simple for an n.c. motor is provided, requiring no mechanical gear-box arrangement. Furthermore, by this control circuit, further control facilities are readily provided, which could be only less readily provided using a mechanical gear-box arrangement. Such facilities are especially useful while the control circuit is incorporated in an apparatus for supplying a liquid composition at a desired feed rate, for example a so-called thermo-cementing and folding machine of the type used in the shoe industry and allied trades.

DESCRIPTION OF THE DRAWINGS

There now follows a detailed description, to be read with reference to the accompanying drawings, of one machine in accordance with the invention. This machine, it will be appreciated, has been selected for description merely by way of exemplification of the invention and not by way of limitation thereof.

In the accompanying drawings

DESCRIPTION OF THE PREFERRED EMBODIMENT

Figure 1:
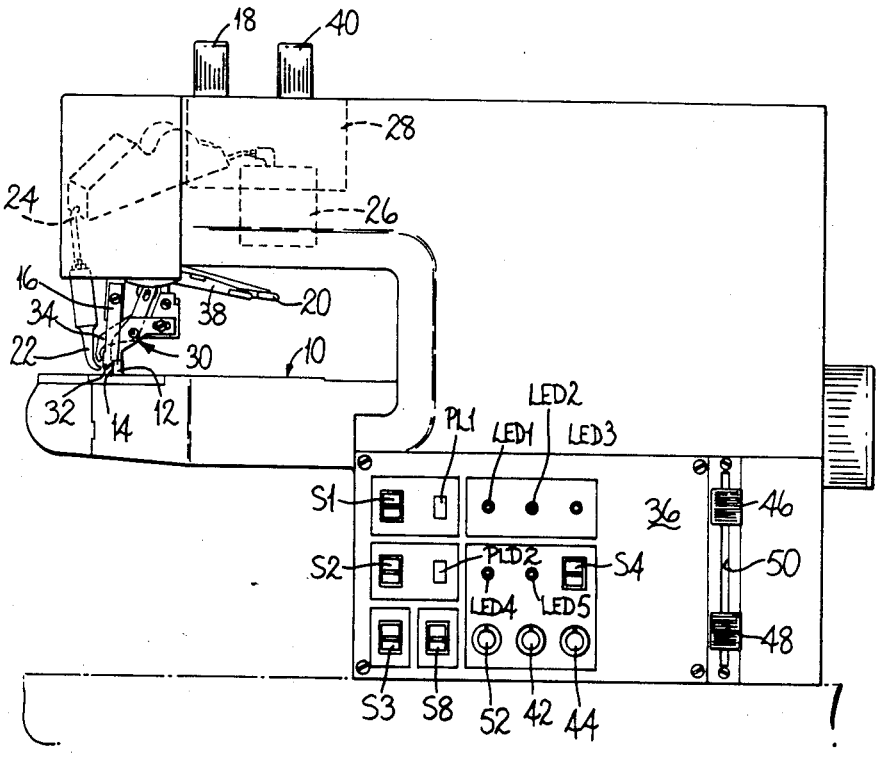
FIG. 1 is a front view of the machine to be described.

The machine now to be described is a so-called thermo-cementing and folding machine, which finds use in the shoe industry and allied trades, where it is desired to fold the edge of the workpiece over on itself and secure it in a folded condition. To this end, the machine comprises a work table 10 on which is supported a block 12 having a work-guiding surface 14 which curves upwardly, out of the plane of the work table 10, so as to provide a smooth fold-initiating surface for a workpiece the edge of which is to be folded. For limiting the movement of the workpiece edge of the surface 14, a gauge finger 16 is provided which is adjustable heightwise by means of an adjustment knob 18. For raising the gauge finger 16 out of its operative position, furthermore, a manually operable lever 20 is provided.

For assisting in the formation of a fold, furthermore, a creaser foot 22 is mounted with its end adjacent the block 12. The creaser foot has a central passage through which hot-melt adhesive can be fed, the foot having an outlet through which adhesive can be fed onto the central region of the part of the workpiece to be folded. The passage in the creaser foot is supplied through a delivery tube 24 which is noted "upstream" to a gear pump 26 which in turn is fed from a melt chamber 28. Because the adhesive is a hot-melt, the melt chamber 28, delivery tube 24 and creaser foot 22 are each provided with a separate heater, respectively H1, H2, and H3, of the electric cartridge type. The delivery tube, furthermore, is clad with appropriate thermal insulation.

For moving the creaser foot 22 out of its operative position a manually operable lever 38 is provided, which together with the lever 20, thus facilitates the introduction of a workpiece to the operating locality of the machine. The heightwise position of the creaser foot 22 is adjustable by an adjustment knob 40.

The machine, as so far described above, is conventional. Furthermore, also as is conventional, the machine comprises a snipping knife arrangement generally designated 30 and comprising a fixed blade 32 and a movable blade 34 mounted on the fixed blade, the blades being so arranged, "downstream" of the block 12, that they can cut the upstanding edge portion of the workpiece which is supported by the block 12. In general, the snipping knife arrangement 30 is used where the edge of the workpiece defines a so-called "inside" curve.

For feeding a workpiece past the block 12 and the creaser foot 22, and also for completing and consolidating the fold, a work feed arrangement is provided comprising a hammer and anvil (not shown) which are moved orbitally, the arrangement being such that over a given part of the orbit, the hammer and anvil trap the workpiece therebetween as they move rearwardly over a given distance (feed length) and at a given speed (feed speed). The hammer and anvil are driven through a main drive shaft (not shown) of the machine, by means of an electric motor (not shown) through a clutch. The motor speed, and thus the feed speed, is controlled by a first treadle (not shown). A second treadle (also not shown) is also provided for operating two switches S6, S7, the arrangement being such that only one of said switches can be operated at any one time. Switch S6 is effective to reduce the feed length, which thereby causes pleating of the folded over margin of the workpiece (and is thus useful on sharp so-called "outside"

curves). For controlling the feed length, "maximum" and "minimum" stops 46,48 are provided, said stops being arranged to project through an appropriate slot 50 in the control panel to facilitate operator setting thereof. Switch S7 is effective to cause the snipping knife arrangement 30 to operate.

For swiching the supply of adhesive on and off, a main switch S4 is provided on a control panel 36 of the machine, and, for controlling the supply of adhesive during the operation of the machine, a knee-operated switch S5 is provided.

The control panel 36 of the machine has, in addition to the main "adhesive supply" switch S4, a mains on-off switch S1 and a motor on-off swich S2. Mains power is thus supplied to two solenoids SOL1, SOL2 and to heaters H1 H2, to be referred to hereinafter, and also to a transformer (not shown) which steps down the voltage to 12 volts. A 12 V a.c. supply is thus supplied to a work lamp (not shown) which can be switched on by switch S3, also on the control panel 36. In addition, this circuit supplies power to a further heater H3. From this 12 V a.c. circuit, furthermore, is derived an sunsmoothed 12 volt d.c. circuit which supplies power to a mains-controlled control box MI supplying a "mains interrupt" signal to be referred to hereinafter. In addition, there is derived from the 12 V a.c. circuit a smoothed 12 V d.c. circuit which supplies power to an n.c. motor M (preferably a stepping motor), which will be referred to hereinafter. From the smooth 12 V d.c. circuit, furthermore, is derived a 5 V circuit, which drives a central processor unit (CPU) and circuits, and supplies power to switches S4, S5, S6 and S7 thermisters TS1, TS2, TS3 and potentiometers VR4, VR5 and VR6, each of which will be referred to hereinafter.

The control panel 36 also is provided with various indicator devices, including light-emitting diodes LED 1, LED 2 and LED 3, associated respectively with heaters H1, H2 and H3, and LED 4 and LED 5, associated respectively with an "adhesive supply" circuit and with the knee-operated switch S5, also as to be described in detail later.

As already mentioned, switches S6 and S7, which are operated under the control of the second treadle of the machine, cannot be operated simultaneously, the one switch being operated by depression of the toe of the operator on the treadle and the other by depression of his or her heel. In some cases, however, it is desirable that snipping should take place while the feed length is reduced, and to this end a further control switch S8 is provided on the control panel 36 which is effective, in combination with switch S6, to cause snipping to take place simultaneously with the reduced feed length.

Figure 2:
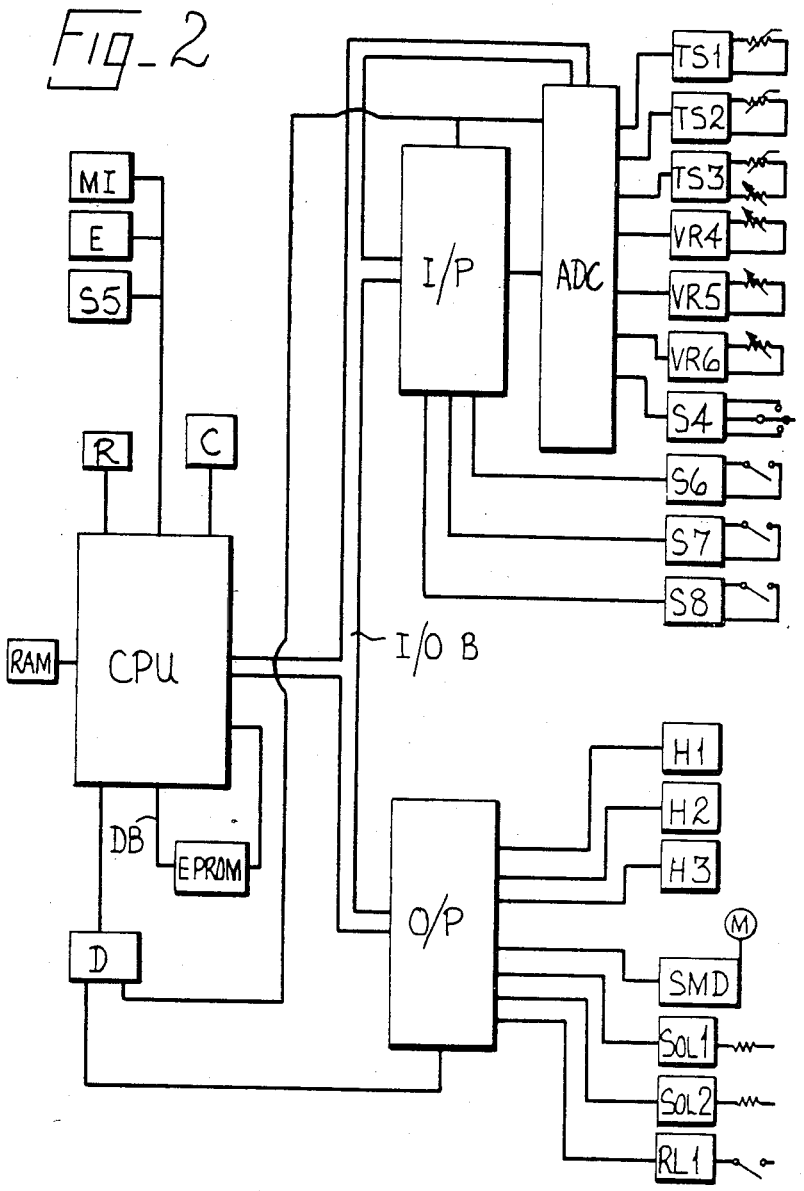
FIG. 2 is a block diagram of an electronic control circuit of said machine.

The machine in accordance with the invention is computer-controlled and comprises a central processor unit (CPU) in the form of a single chip 8-bit micro-computer (preferably a Zilog Z8681 which, in addition to a micro-processor, also incorporates a random access memory (RAM) (shown separately in FIG. 2) and scratch pad; this micro-computer is obtainable from Zilog Inc.) For the internal timing of the CPU a system clock C, comprising a free-running 8 MHZ crystal, is provided.

The CPU is connected via I/O bus I/OB with input and output ports IP, OP and via memory address and data bus DB with a non-volatile memory in the form of an EPROM (erasable programmable read-only memory), which is accessed by the CPU via the data bus DB for instructions to execute. A conventional decoder D is also provided for controlling the functioning of the input and output ports IP, OP.

The control circuit also includes an analogue-to digital converter (ADC) to which signals are supplied by the potentiometers VR4, VR5, VR6, thermisters TS1, TS2, TS3, and switches S4, S8. The ADC is interrogated the the CPU, via the I/O bus, each time a mains interrupt signal is supplied to the CPU by the control box MI. More particularly, the various channels of the ADC are interrogated in turn, one in response to each mains interrupt in a so-called "wrap around" sequence. The ADC in response to a signal from the decoder D, supplies information as to the state of the interrogated channel via the input port.

Also supplying information via the input port in response to enabling signal from the decoder D, are switches S6, S7, while switch S5 provides a direct "interrupt" signal to the CPU.

The electronic control circuit also comprises a re-set sub-circuit R by which, upon starting up of the machine, the CPU is enabled to set the controls to their correct state in a rapid manner. This sub-circuit R is directly connected into the CPU for this purpose.

A further, direct, "interrupt" input is provied to the CPU from a shaft encoder E which is driven by the main drive shaft of the machine. The shaft encoder E is conveniently a disc having a plurality of (preferably sixteen) equally spaced notches, with which are aligned two opto-switches operating through a flip-flop (set re-set) to supply pulses to the CPU. The switches are spaced apart from one another by a distance more than the width of a notch, so that if, for example, the main drive shaft is arrested in a position in which the edge of a notch is aligned with one of the switches, any vibration of the disc, e.g. caused by vibrations of the machine will not result in the generation and supply to the central processing unit of a series of pulses, but rather that switch, having once emitted a pulse, will be disabled until the flip-flop is re-set by the other switch having been actuated.

In response to the various signals thus supplied to the CPU, the CPU supplies outputs, via output port OP, to sub-circuits controlling the heaters H1, H2, H3 to sub-circuits controlling the solenoids SOL1, SOL2, to motor drive SMD and to the various LEDs referred to above.

Dealing now more specifically with particular features of the invention, the n.c. motor M is operatively connected to the gear pump 26 and serves to control the rate of feed of adhesive through the adhesive-supply system.

To this end, switch S4, which is a three-position switch, is provided for manually switching the adhesive supply system on and off; the third position will be referred to later. Switch S4 is an overall control for switching at the start and finish of a working shift. In addition, knee-operated switch S5 is proved for switching the system on and off in each working cycle. Both switches S4, S5 serve through the CPU, to switch motor M on and off.

The operating speed of the motor M is controlled by the shaft encoder E, as will now be described. In response to each pulse generated by the shaft encoder E, a digital "increment" value is added to an accumulator stored in the RAM of the CPU. This increment value is determined by an operator setting of the potentiometer VR4, which is provided with an adjustment knob 42 on the control panel 36 for this purpose. The potentiometer VR4 forms part of a metering circuit which supplies a signal through the ADC to the CPU. The range of adjustment of the potentiometer VR4 corresponds to a range of ratios of the main drive shaft to rotation of the motor M. In the machine described, the range of ratios is approximately 40:1 to 400:1 and this range of ratios corresponds to an output from the ADC of 255 to 0 (FF to 0 hex). The value of the signal from the ADC constitutes the increment value. The accumulator adds the increment value to the accumulated total in response to each pulse from the shaft encoder, and each time the accumulator "oerflows", the motor M receives a drive pulse; in the case of a stepping motor, it is stepped through one step.

It will thus be appreciated that, by altering the position of adjustment knob 42, the rate of feed of adhesive in relation to the rotational speed of the shaft can be adjusted by the operator.

In a thermo-cementing and folding machine, as mentioned above, it is sometimes desirable to reduce the feed length, irrespective of the feed speed, in order to steer round "outside" curves. To this end, as is conventional, solenoid SOL1 is provided which switches the feed length between maximum and minimum as determined by the stops 46, 48, referred to above. More particularly, as is conventional the solenoid SOL1 serves to cause the geometry of a linkage system to be so varied as to consequently vary also the distance through which the hammer and anvil move in feeding the workpiece. In the machine in accordance with the invention, solenoid SOL1 is operated by actuation of treadle-operated switch S6.

Reducing the feed length is of course effective to reduce the rate at which the workpiece is fed through the machine, but without reducing the feed speed, as measured at the main drive shaft, so that the amount of adhesive fed is not generally affected by a reduction of feed length. This can lead to excessive adhesive being supplied, which adhesive may of course be squeezed from beneath the fold, leaving an unsightly amount of adhesive visible in the finished workpiece. To overcome this problem therefore, a "metering modify" circuit is provided which supplies an appropriate signal through the input port. This circuit operates in combination with the "metering" circuit and with the circuit incorporating the switch S6 so that, upon operation of the switch S6, the increment value referred to above is reduced, thereby reducing the frequency of "overflow" of the accumulator, and thereby increasing the ratio between the main drive shaft and the output shaft of the motor M. It has been found that a reduction of 50% of the increment value is appropriate when operating with reduced feed length.

For enabling the "metering modify" circuit, switch S4 is provided with contacts which are closed when in its third position. Of course, in the third position, the adhesive supply is still switched "on".

At the end of an operating cycle of the machine, it is regarded as desirable to avoid drooling of the adhesive from the passage in the creaser foot 22. This is achieved conventionally by a "suck back" arrangement. In the machine in accordance with the invention, "suck back" is achieved by reversing the direction of rotation of the motor M through a predetermined distance. This takes place independently of the rotation of the main drive shaft. Conveniently, this reversing of the motor drive takes place upon operation of the knee-operated switch S5, the main function of which is to cause the supply of adhesive to be terminated. Furthermore, in the machine in accordance with the invention, the amount of "suck back" can be adjusted by the operator and to this end the potentiometer VR5 is provided in a "suck back setting" circuit, the potentiometer having an adjustment knob 44 on the control panel 36. As already mentioned, the "suck back setting" circuit supplies a signal through the ADC so that the predetermined distance can be varied according to operator preference. In the particular case, where a stepping motor is used to drive the gear pump 26, a range of 0 to 128 steps in the reverse direction has been found to be suitable, and the ADC serves to provide a "suck back" value in the range 0 to 255 (0 to FF hex) in response to the setting of the potentiometer VR5.

In order, furthermore, to avoid a deficiency of adhesive at the start of the next following machine cycle, the motor M driving the gear pump 26 is actuated, upon actuation of the knee-operated switch S5, and operates through a predetermined distance at a fast speed. The predetermined distance may be the same as the "suck back" distance, or, if desired, may be a proportion (whether greater or smaller) of that distance. The adhesive sucked back in the preceding machine cycle is thus restored at the start of each machine cycle. It is to be noted that, in order to prevent accidental switching on of the adhesive when the machine is not operating, the operation of the gear pump 26 at a fast speed is enable as aforesaid only if the main drive shaft is rotating. More especially, the "fast speed" operation of the pump is initiated only after two pulses have been generated by the shaft encoder E.

As is also conventional in thermo-cementing and folding machines, the operation of the snipping knife arrangement 30 is controlled by solenoid SOL2, which is operated upon actuation of the treadle-operated switch S7.

As already mentioned above, switches S6 and S7 cannot be operated simultaneously under the control of the treadle. In some cases, however, it is desirable that snipping should take place while the feed length is reduced. To this end, therefore, control switch S8 is provided, actuation of which is effective, when switch S6 is also actuated to cause snipping to take place simultaneously with the reduced feed length; that is to say, actuation of switch S8 causes solenoid SOL2 to be energized when switch S6 is actuated.

When the machine is switched on at the start of a working shift, the CPU is first enabled and ensures that any incorrect settings of the various operating elements are corrected. Thereafter, signals are supplied via the output port O/P to heaters H1, H2 and H3, which respective supply heat to the melt chamber 28, delivery tube 24 and creaser foot 22. Because of the construction of the various elements, it is likely that the creaser foot 22 will heat up considerable more rapidly than the melt chamber 28, while the delivery tube 24 will heat more rapidly than the melt chamber but less rapidly than the creaser foot. Consequently, initially only the heater H1 for the melt chamber 28 is switched on. The heater H2 for the delivery tube 24 is then switched on at a predetermined stage in the heating up of the melt chamber, and finally the heater H3 for the creaser foot 22 is switched on at a predetermined stage in the heating up of the delivery tube.

For sensing the temperature of the melt chamber thermistor TS1 is provided, incorporated in a sub-circuit by which a signal is supplied to the ADC, which converts the signal to a numerical value between 255 and 0 (FF hex and 0). The switching on of the heater H2 for the delivery tube 26 takes place when the value of the ADC output reaches a predetermined number. Similarly, the temperature of the delivery tube 24 is also sensed by thermistor TS2, incorporated in a sub-circuit identical with that for the melt chamber, and at a given numerical value, the heater H3 for the creaser foot is switched on. In the case of both heaters H1, H2, a "target" temperature is pre-set and cannot be varied by the operator. The temperature control sub-circuits operate, once the target temperature has been achieved, to maintain the temperature at the target, in a manner described below.

The temperature of the creaser foot is also sensed by thermistor TS3, incorporated in a sub-circuit which is generally similar to the aforementioned sub-circuits, but which also includes potentiometer VR6, having an adjustment knob 52 on the control panel. The maximum resistance of the potentiometer V6 is relatively small in relation to that of the thermistor TS3, but is sufficient to enable the temperature of the creaser foot to be varied over a range of some 20° C., at the level of temperature at which it is expected the machine will normally operate; the normal temperature range would be expected to be within approximately 130° to 150° C.

For maintaining the temperatures at the "target", a program stored in the EPROM establishes a band of numerical values extending at either side of the target value, this band representing a band of temperatures at either side of the target temperature. When the numerical value as sampled lies within the band, the approriate duty cycle for the heaters over the next time interval (determined by the mains interrupt) is calculated; more specifically, the difference between the actual and target temperatures is calculated and, depending upon this difference, a proportion of the time interval is determined during which the heater is to be switched on, and appropriate instructions are issued, which are then executed during the time interval. Thus, for example, if the target value is almost achieved, the program could calculate that the heater need be switched on for only 55% of the time interval, in which case after 55 main interrupts, the heater will be switched off for the remainder of that time interval.

It will thus be appreciated that, especially once the target value has been achieved, maintenance of the target temperature is much more accurately achieved than would be the case with a conventional thermostatic device.

During the heating up period, LED4 on the control panel 36 flashes to indicate that heating up is taking place. When the target temperatures in all three areas have been achieved. LED4 is constantly illuminated.

If, after the heating up period, the numerical value corresponding to the temperature of any heater is observed to have moved outside the band, and if it remains so for a predetermined number of (preferably ten) consecutive interrogations, a warning signal is supplied to an appropriate one of the three light-emitting diodes LED1, LED2, LED3, which, as mentioned above, are associated respectively with the heaters H1, H2, H3. In the event that the fault has arisen as a consequence of the corresponding thermistor entering an "open circuit" condition, in which condition it will of course supply a permanent maximum signal (FF hex) to the ADC, the appropriate LED will flash. In such a case, furthermore, in order that the operator can continue to use the machine for a limited period, e.g. in order to finish a batch of work being operated upon, even though the monitoring of the performance of the heaters is no longer being correctly carried out, while at the same time ensuring that the machine will not be damaged by continued use, once a malfunction of the thermistor is detected, the machine will continue to operate for a further pre-determined period (preferably ten minutes), during which period a 50% duty cycle is implemented for the heater associated with the malfunctioning thermistor. That is to say, during each time interval the heater will be switched on and off for equal proportions.

At the end of the predetermined period, the CPU instructs a relay RL1 to drop out, whereby the mains power supply is cut off and thus the machine operation is terminated and all the heaters are de-energized.

The diodes LED1, LED2, LED3 are also used to diagnose any "heater channel" failures, in which case the appropriate LED is constantly illuminated. Such failures include failure of the heating elements and of the triacs controlling the heater elements, and also if one of the thermistors falls out of or is removed from the pocket in which it is to be located. In such circumstances, the warning is indicated when the numerical value moves outside the band (and in this case the observed change in signal is likely to take place more slowly than in the case of a thermistor going into "open circuit" condition—which feature of course is utilized to distinguish between the failure of the sensing circuit and that of the heater circuit or heater control circuit). If thereafter the change in numerical value continues to take place away from the target value, an "interlock" signal is supplied by the thermistor, causing the power supply to the machine to be switched off, again by relay RL1 dropping out.

The relay RL1 also serves as a general "watch dog" over the whole of the control circuit. To this end, it is maintained in a "made" condition during normal operation of the machine by a control sub-circuit which is "refreshd" at regular intervals, failure to refresh the sub-circuit causing the relay RL1 to drop out. More particularly, the sub-circuit receives a signal at each mains interrupt, the signal serving to change the state of the circuit between "1" and "0", the arrangement being such that switching to the "1" state constituting the "refresh" signal. The sub-circuit is arranged to become de-energized, in the absence of a refresh signal, after a time interval which is greater than the interval between two "1" signals. De-energization of the sub-circuit of course switches off the relay, thereby terminating the power supply to the machine. 9n

We claim:

1. A computer-controlled circuit for an n.c. motor comprising: p1 means, including a potentiometer, for supplying an analog signal, means, including an analog-to-digital converter, for converting the supplied signal to a digital value, means, for addressing the analog-to-digital converter at timed intervals, means for receiving the digital signal each time the analog-to-digital converter is addressed and for summing the values of successively received signals to a maximum, said means thereupon re-setting to zero, and means, responsive to the maximum being reached, for supplying a signal to the computer, which in turn generates a drive signal that is supplied to the n.c. motor.

2. A computer-controlled circuit for driving an n.c. motor at a rate proportional to an independently driven rotating shaft, comprising means, including a potentiometer, for supplying an analog signal, means, including an analog-to-digital converter, for converting the supplied signal to a digital value, a shaft encoder, driven by the independently driven shaft, for supplying a series of timed pulses to the computer, means operable under the control of the computer, in response to said pulses, for addressing the analog-to-digital converter, means for receiving the digital signal each time the analog-to-digital converter is addressed and for summing the values of successively received signals to a maximum, said means thereupon re-setting to zero, and means, responsive to the maximum being reached for supplying a signal to the computer, which in turn generates a drive signal and supplies it to the n.c. motor.

3. A computer-controlled circuit according to claim 2 comprising means, operable in response to a signal, for driving the n.c. motor in a reverse direction through a predetermined distance, independently of the rotation of the shaft.

4. A computer-controlled circuit according to claim 3 wherein said reverse drive means comprises operator-controlled means, including a second potentiometer, for setting the distance through which the n.c. motor is so driven, said means comprising:

means for supplying a second analog signal to the analog-to-digital converter, second means for receiving the digital signal from the analog-to-digital converter in response to a "termination" signal, and means for supplying a signal to the computer which generates a corresponding drive signal and supplies it to the n.c. motor.

5. A computer-controlled circuit ccording to claim 4 comprising switch means for disconnecting the n.c. motor from the shaft and for initiating operation of the reverse drive means.

6. A computer-controlled circuit according to claim 3 comprising means operable in response to a "start" signal, following operation of the reverse drive means, for driving said motor through a predetermined distance in a forward direction, independently of the rotation of said shaft.

7. A computer-controlled circuit according to claim 5 wherein said switch means is effective, upon re-actuation after the n.c. motor has been driven as aforesaid in a reverse direction, to drive said motor through a predetermined distance in a forward direction, independently of the rotation of said shaft, and thereafter to a re-connect said motor to said shaft.

8. A computer-controlled circuit according to claim 7 wherein said second potentiometer also sets the predetermind distance through which the n.c. motor is independently driven as aforesaid in a forward direction.

9. Apparatus for supplying a liquid composition through a nozzle at a feed rate which is proportional to the rate at which a workpiece is fed past said nozzle, the apparatus comprising a gear pump connected to a supply of liquid composition;

an n.c. motor for driving said gear pump, means, including a potentiometer, for supplying an analog signal;

means, including an analog-to-digital converter, for converting the supplied signal to a digital value;

workpiece feeding means;

a shaft encoder, driven by a drive shaft of the workpiece feeding means, for supplying a series of timed pulses to a computer;

means operable under the control of the computer, in response to said pulses, for addressing the analog-to-digital converter;

means for receiving the digital signal each time the analog-to-digital converter is addressed and for summing the values of successively received signals to a maximum, said means thereupon re-setting to zero; and means, responsive to the maximum being reached for supplying a signal to the computer, which in turn generates a drive signal and supplies it to the n.c. motor.

10. Apparatus according to claim 9 comprising operator-actuatable means for varying the setting of said potentiometer, thus to vary the amount of liquid composition supplied in relation to the feed rate of the workpiece.

11. Apparatus according to claim 10 wherein the operator-actuatable means comprises:

means for varying the ratio of the rate of rotation of the shaft and the rate at which the n.c. motor is driven in the range 40:1 to 400:1 .

12. Apparatus according to claim 9 wherein the workpiece feeding means comprises a motor, by which said shaft is driven, a workpiece-engaging arrangement operable, in response to rotation of said shaft, to engage and feed the workpiece.

means for varying the workpiece feed rate without altering the shaft rotation speed, and means, operable in response to a change in the workpiece feed rate, for varying the digital value converted form the analog signal supplied to the analog-to-digital converter, thus to cause the rate at which liquid composition is supplied through the nozzle to be varied accordingly.

13. Apparatus according to claim 9 comprising switch means for enabling/disabling the means for varying the digital value so as to cause the rate at which liquid composition is supplied through the nozzle.

14. Apparatus according to claim 9 comprising means operable, in response to a signal, for driving the n.c. motor in a reverse direction through a predetermined distance, independently of the rotation of the shaft, to cause the liquid composition to be sucked back in the nozzle.

15. Apparatus according to claim 14 wherein said reverse drive means comprises operator-controlled means, including a second potentiometer, for setting the distance through which the n.c. motor is so driven, said means comprising means for supplying a second analog signal to the analog-to-digital converter, second means for receiving the digital signal from the analog-to-digital converter in response to a "termination" signal, and means for supplying a signal to the computer which generates a corresponding drive signal and supplies it to the n.c. motor.

16. Apparatus according to claim 14 comprising means operable in response to a "start" signal, after operation of the reverse drive means, for driving said motor through a predetermined distance in a forward direction, independently of the rotation of said shaft.

17. Apparatus according to claim 14 comprising switch means for initiating operation of the reverse drive means and, upon re-actuation, for initiating driving said motor through a predetermined distance in a forward direction independently of the rotation of the shaft.

18. Apparatus according to claim 17 comprising operator-controlled means, including a second potentiometer, for setting the predetermined distance through which the n.c. motor is driven in both the reverse and the forward direction.

* * * * *